US008025969B2

(12) United States Patent
Zhang et al.

(10) Patent No.: US 8,025,969 B2
(45) Date of Patent: Sep. 27, 2011

(54) PET YARNS WITH IMPROVED LOOP TENSILE PROPERTIES

(75) Inventors: Heping Zhang, Summerville, SC (US); Craig Valentine, Summerville, SC (US)

(73) Assignee: Voith Paper Holding GmbH & Co. KG, Heidenheim (DE)

( * ) Notice: Subject to any disclaimer, the term of this patent is extended or adjusted under 35 U.S.C. 154(b) by 17 days.

(21) Appl. No.: 12/289,118

(22) Filed: Oct. 21, 2008

(65) Prior Publication Data

US 2010/0099320 A1 Apr. 22, 2010

(51) Int. Cl.
*D02G 3/00* (2006.01)
*D03D 15/00* (2006.01)

(52) U.S. Cl. ..... 428/375; 442/199

(58) Field of Classification Search ..... 428/375; 442/199

See application file for complete search history.

(56) References Cited

U.S. PATENT DOCUMENTS

| | | | | |
|---|---|---|---|---|
| 4,867,936 | A | 9/1989 | Buyalos et al. | |
| 5,178,813 | A | 1/1993 | Akatsu et al. | |
| 5,405,695 | A | 4/1995 | Akatsu et al. | |
| 6,147,128 | A | 11/2000 | Reither | |
| 7,138,449 | B2 | 11/2006 | Valentine et al. | |
| 7,163,743 | B2 | 1/2007 | Atwood et al. | |
| 2005/0196611 | A1 | 9/2005 | Park et al. | |
| 2005/0260409 | A1 | 11/2005 | Payne et al. | |
| 2007/0130696 | A1 | 6/2007 | Payne et al. | |
| 2007/0243378 | A1 * | 10/2007 | Cho et al. | 428/375 |
| 2009/0311529 | A1 | 12/2009 | Zhang et al. | |

FOREIGN PATENT DOCUMENTS

| | | |
|---|---|---|
| EP | 0 453 100 | 10/1991 |
| EP | 0 532 510 | 3/1993 |
| EP | 0 888 478 | 1/1999 |
| EP | 0 889 990 | 1/1999 |
| EP | 1 887 111 | 2/2008 |
| JP | 04 300310 | 10/2004 |
| JP | 2006 028704 | 2/2006 |
| WO | WO 99/58598 | 11/1999 |

OTHER PUBLICATIONS

Paper entitled "Physical Properties of Textile Fibers", The Textile Institute, Manchester 2nd Ed. 1975 p. 410ff by W.E Morton and J.W.S. Hearle.

* cited by examiner

*Primary Examiner* — D Lawrence Tarazano
*Assistant Examiner* — Ricardo E Lopez
(74) *Attorney, Agent, or Firm* — Greenblum & Bernstein P.L.C.

(57) ABSTRACT

Poly(ethylene terephthalate) monofilaments having improved loop strength and toughness as well as improved tensile strength and tensile toughness. The yarns can have a loop toughness of at least 2 gf/den, a loop tenacity of at least 7 gf/den, a tensile toughness of at least 0.9 gf/den, a tensile tenacity of at least 4 gf/den, and a DSC crystallinity of at least 35%. A process for the production of poly(ethylene terephthalate) monofilaments includes melt extrusion, orientation of the extrudates by stretching, and further stretching as well as heat treating the stretched monofilaments. Industrial fabrics, especially fabrics for paper machine clothing, can be made of such monofilaments as load bearing yarns that resist loop failure and that resist fabric creep at high temperature and high load.

23 Claims, 4 Drawing Sheets

| sample ID | Total draw ratio | final draw ratio | 1st draw ratio | 2nd draw ratio | relax ratio | | Loop tough-ness [(in gf)/(den in)] | Loop tenacity [gf/tex] | Loop elongation at break [%] | | Tensile tough-ness [(in gf)/(den in)] | Tensile tenacity [gf/tex] | Tensile elongation at break [%] | DSC crystallinity [%] | Estimated half width of crystal melt peak [degree C] |
|---|---|---|---|---|---|---|---|---|---|---|---|---|---|---|---|
| control | 5.25 | 4.25 | 4.3 | 1.22 | 0.81 | | 5.4 | 45 | 20 | | 8.1 | 38.7 | 40 | 42% | 18 |
| invention | 5.25 | 4.62 | 3.0 | 1.75 | 0.88 | | 22.5 | 77 | 48 | | 13.5 | 45.0 | 48 | 41% | 20.3 |
| sample-1 | 5.27 | 4.74 | 3.1 | 1.70 | 0.90 | | 18.0 | 72 | 50 | | 11.7 | 40.5 | 53 | | |
| sample-3 | 5.27 | 4.90 | 3.1 | 1.70 | 0.93 | | 15.3 | 72 | 35 | | 10.8 | 41.4 | 47 | | |
| sample-5 | 5.44 | 4.79 | 3.2 | 1.70 | 0.88 | | 17.1 | 72 | 40 | | 9.9 | 38.7 | 44 | | |
| sample-2 | 5.44 | 4.90 | 3.2 | 1.70 | 0.90 | | 24.3 | 81 | 50 | | 12.6 | 43.2 | 52 | | |
| sample-4 | 5.44 | 5.06 | 3.2 | 1.70 | 0.93 | | 13.5 | 77 | 30 | | 9.9 | 43.2 | 38 | | |

Fig. 3

Fig. 4

| | Fabric with CONTROL warp yarn | Fabric with INVENTION warp yarn |
|---|---|---|
| Fabric air permeability /CFM | 292 | 279 |
| Fabric thickness [mm] | 1.47 | 1.46 |
| fabric strength in warp direction [Kg/cm] | 161 | 179 |
| fabric extension at break in warp direction [%] | 47 | 59 |
| Bending stiffness [Kg/cm] uppermost | 0.44 | 0.45 |

Fig. 5

| Load [KN/m] | Load per single warp yarn [N] | Time [min] | Fabric Creep at 125C with CONTROL warp yarn [%] | Fabric Creep at 125C with INVENTION warp yarn [%] |
|---|---|---|---|---|
| 0.9 | 0.5 | 1 | 0 | 0 |
| 0.9 | 0.5 | 21 | 0.07 | 0.08 |
| | | | | |
| 1.9 | 1.1 | 22 | 0.4 | 0.37 |
| 1.9 | 1.1 | 40 | 0.59 | 0.55 |
| | | | | |
| 3.9 | 2.1 | 63 | 1.27 | 1.19 |
| 3.9 | 2.1 | 80 | 1.59 | 1.4 |
| | | | | |
| 4.7 | 2.6 | 84 | 1.76 | 1.53 |
| 4.7 | 2.6 | 102 | 1.9 | 1.71 |

PET YARNS WITH IMPROVED LOOP TENSILE PROPERTIES

BACKGROUND OF THE INVENTION

1. Field of the Invention

The present invention relates to monofilaments made of poly(ethylene terephthalate) (PET) with good and/or improved loop mechanical properties as well as good and/or improved tensile mechanical properties, as well as process for producing such monofilaments. The monofilaments are preferably configured and/or utilized for industrial fabric applications and can take the form on load bearing yarns that resist loop failure and resist tensile creep at high temperature.

2. Discussion of Background Information

Poly(ethylene terephthalate) (PET) filaments of high strength are well known in the art, and are commonly utilized in industrial applications including being utilized as reinforcement members in conveyor belts, tire cords, reinforced rubber, and paper machine clothing.

Significant efforts have been made to establish the mechanical properties required for industrial applications. Among other properties, high tensile strength and high modulus are most demanding. Monofilaments are typically required to bear high load, and to resist deformation (creep) in various applications. Those skilled in the art fully realize that the high strength and modulus for the filaments can be achieved by stretching the extrudates in order to orient the polymer microstructure. A subsequent annealing processes can further improve strength and modulus by repairing defects generated during the stretching process, and by inducing higher crystallinity of the final filaments.

The high stretching and high temperature annealing process, however, can cause a brittle failure mode in the filaments when subjected to high loads, i.e., greater than about 11 pounds/inch (lbs/in). The brittle failure can be manifested more readily in a loop breaking mode. Under tension, a looped filament can easily become fibrillated leading to catastrophic break at the loop area. FIG. 1 shows a typical example of such a failure at a loop area of a PET monofilament.

Toughness or total work/energy required to break a filament (rather than strength) is a better measure for ultimate filament mechanical durability. It combines both strength and elongation of the tested sample, and is conveniently calculated as the area underneath the stress-strain curve at testing. Filaments having a brittle failure mode would typically have a very low toughness, especially loop toughness.

Many efforts, industrial and academic alike, have been made in achieving high toughness PET filaments. For example, U.S. Pat. No. 4,867,936 (1989) describes a process for producing such filaments primarily by reducing polymer degradation during melt processing. The maximum tensile toughness achieved is up to 0.67 grams-force/denier (gf/den). EP 1,887,111 discloses additional efforts that have been made in increasing the drawing of PET by the use of additives.

Although not directed to PET, U.S. Pat. No. 5,405,695, the disclosure of which is hereby expressly incorporated by reference in its entirety, describes a process for achieving high toughness in filaments of a different semi-crystalline polymer. The process, however, is believed by the inventors of the instant application to be applicable to the production of PET filaments. This patent especially emphasizes the skin-core structure effect of filament on the toughness. Large diameter monofilaments at a diameter range of 0.1-1.5 mm typically have a much poorer toughness compared to multi filaments at a diameter range of a few microns. Fine diameter fibers have a much smaller difference between skin bending and the center (natural line) bending than large diameter monofilaments. In small diameter fibers, microstructure defects are also minimized—further contributing to their superior properties.

Continuous improvements have been required in high strength, high toughness industrial monofilaments to make them suitable for use as load bearing yarns for industrial fabrics in demanding applications.

SUMMARY OF INVENTION

According to embodiments of the invention, a PET monofilament comprises at least the following properties a loop toughness of at least about 1.3 gf/den and a loop tenacity of at least about 7 gf/den.

The PET monofilament may further comprise at least one of the following additional properties a tensile toughness of at least about 0.9 gf/den, a tensile tenacity of at least about 4 gf/den, and a DSC crystallinity of at least about 35%.

The PET monofilament may further comprise at least each of the following additional properties a tensile toughness of at least about 0.9 gf/den, a tensile tenacity of at least about 4 gf/den, and a DSC crystallinity of at least about 35%.

The loop toughness may be at least about 2 gf/den. The monofilament may have a substantially round shaped cross section. The monofilament may have a substantially rectangular shaped cross section. The monofilament may have a substantially elliptical shaped cross section. A smallest width of the cross section of the monofilament may be greater than about 0.05 mm, and is preferably between about 0.2 mm and about 0.8 mm.

According to embodiments of the invention, a paper machine fabric comprises plural PET monofilaments discussed above.

According to embodiments of the invention, a process of making the PET monofilament of described above is provided wherein the process comprises forming an extrudate, quenching the extrudate, stretching of the extrudate in a heat transfer medium, and subjecting the stretched monofilament to relaxing in the heat transfer medium.

The heat transfer medium may comprise one of water, hot air, and steam;

According to embodiments of the invention, a process of making a PET monofilament comprises feeding a dried polymer through a spinneret to form an extrudate, water quenching the extrudate, stretching of the extrudate in a heat transfer medium, and subjecting the stretched monofilament to relaxing in the heat transfer medium.

The PET monofilament may comprise at least the following properties a loop toughness of at least about 1.3 gf/den and a loop tenacity of at least about 7 gf/den.

The PET monofilament may further comprise at least one of the following additional properties a tensile toughness of at least about 0.9 gf/den, a tensile tenacity of at least about 4 gf/den, and a DSC crystallinity of at least about 35%.

The PET monofilament may further comprise at least each of the following additional properties a tensile toughness of at least about 0.9 gf/den, a tensile tenacity of at least about 4 gf/den, and a DSC crystallinity of at least about 35%.

The loop toughness may be at least about 2 gf/den.

According to embodiments of the invention, the PET monofilament described herein can be used to make a paper machine fabric. According to a further aspect of the invention, a paper machine fabric utilizes monofilament yarns of the type described herein wherein the yarns can be warp and/or weft yarns.

According to embodiments of the invention, a PET yarn comprises at least the following properties a loop toughness of at least about 2 gf/den, a loop tenacity of at least about 7 gf/den, a tensile toughness of at least about 0.9 gf/den, a tensile tenacity of at least about 4 gf/den, and a DSC crystallinity of at least about 35%.

According to embodiments of the invention, a process of making the PET yarn described above comprises forming an extrudate, quenching the extrudate, stretching of the extrudate in a heat transfer medium, and subjecting the stretched monofilament to relaxing in the heat transfer medium.

The heat transfer medium may comprise one of water, hot air, and steam.

Another non-limiting embodiment of the instant invention provides PET monofilaments having both high tensile toughness and high loop toughness. By way of non-limiting example, the PET monofilament of the invention can have the following properties:

a) a loop toughness of at least about 2 gf/den,
b) a loop tenacity of at least about 7 gf/den,
c) a tensile toughness of at least about 0.9 gf/den,
d) a tensile tenacity of at least about 4 gf/den, and
e) a DSC crystallinity of at least about 35%.

The PET monofilaments of the invention can also have various cross-sectional shapes such as, e.g., a round cross sectional area and a shaped or profiled (e.g. rectangular, or elliptical) cross sectional area. According to embodiments of the invention, a minor dimension (i.e., the smallest width) of cross sectional area is preferably greater than about 0.05 mm, and is preferably between about 0.2 mm and about 0.8 mm.

The process of making the PET monofilaments of the invention can comprise feeding a dried polymer for melt extrusion through a spinneret, water quenching the extrudate, and subsequently stretching of the extrudate in a heat transfer medium (e.g., water, hot air or steam). This preferably occurs in multiple steps. The production is preferably finished with a relaxing of the stretched monofilament in the heat medium.

The process according to embodiments of the invention aims to achieve a certain physical structure that results in high toughness PET monofilaments as characterized above.

Embodiments of the invention also provide examples of utilizing such high toughness monofilaments in industrial fabrics, especially for paper machine fabrics or clothing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 3 is a table showing process parameters used in making the prior art control monofilaments versus monofilament samples of the invention;

FIG. 4 is a table showing fabric properties of the prior art control fabric versus the fabric of the invention. The warp yarns were arranged in a load bearing direction; and FIG. 5 is a table showing fabric creep of the prior art control fabric versus the fabric of the invention. The warp yarns were arranged in a load bearing direction and subjected to tension at 125° C.

DETAILED DESCRIPTION OF THE INVENTION

Figure 1:
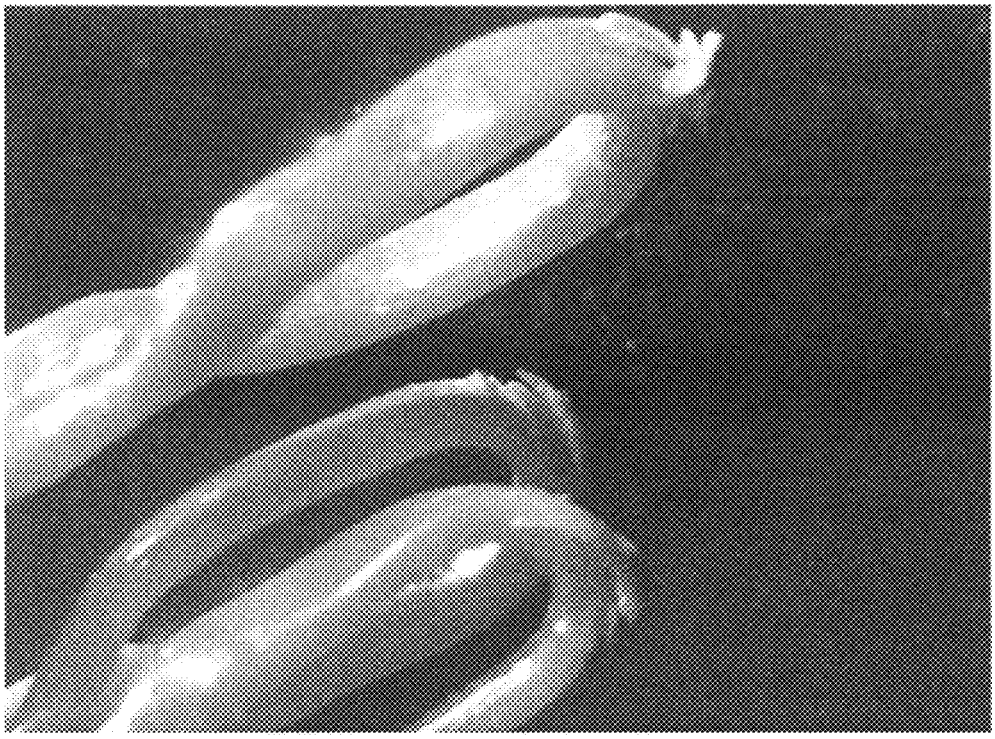
FIG. 1 shows a prior art paper machine fabric made of monofilament yarns whose loop areas have experience failure. This monofilament has a flat cross section and sample monofilaments were taken off a used fabric that failed due to loop break during high temperature and high tension application.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

PET Monofilament

Features of the invention will now be described in detail. The filaments are preferably made of poly(ethylene terephthalate) or PET. By way of non-limiting example, a PET resin suitable for producing the filaments of the invention is a PET homopolymer, having a solution viscosity (ASTM D4603-86) of, preferably about 0.72 dl/g or higher.

The details of the PET resin that can be used in embodiments of the invention are disclosed in, for example, in U.S. Pat. No. 7,163,743, the disclosure of which is hereby expressly incorporated by reference in its entirety.

Production Process

The PET resin with an intrinsic viscosity (IV) of at least about 0.72 dl/g is pre-dried to a moisture level of about <20 ppm. The dried resin is fed into, e.g., a 2.5" single screw extruder. The extruder barrel temperature is set up to be between about 280° C. and about 320° C. The polymer is extruded through a spinneret to generate the extrudate with pre-defined shape by the spinneret holes.

The extrudate is then quenched in a hot water bath at a temperature of between about 40° C. and about 80° C. to solidify the extrudate's shape as well as its microstructure. The solid extrudate is then taken up at a speed of less than about 100 meters/min.

The extrudate is then preferably fed through a heat medium (e.g., water, hot air or steam) while being stretched continuously. The draw ratio (stretching ratio) can be determined by the ratio of the take-up roll's linear speed to the linear speed of the feed roll. The draw ratio, the draw speed, the heat medium and its temperature are determinative parameters in the control of the monofilament microstructure. This process stage preferably utilizes a heated water bath whose water temperature is kept at 97° C. The draw ratios can be those shown in FIG. 3

A second stretch process is then utilized. This can preferably occur downstream of the first stretching discussed above. The second draw ratio can be determined by the ratio of the take-up roll linear speed to the linear speed of the feed roll which was the take-up roll in the first draw. The draw ratio, the draw speed, the heat medium and its temperature are determinative parameters in the monofilament microstructure control. This process stage preferably utilizes a heated water bath whose water temperature is kept at 97° C. The draw ratios can be those shown in FIG. 3

The resulting monofilament is preferably continuously fed into the next heat medium and taken up by another set of rolls. In this stage, the take-up speed can be set to be slower than the feed roll speed of the take-up roll in the second draw. The monofilament is then subjected to a relaxing stage. During this stage of the process, a relax ratio is utilized and is determined by the ratio of the take-up roll linear speed to the linear speed of the feed roll which was the take-up roll in the second draw. The relax ratio, the roll speed, the heat medium and its temperature are determinative parameters in the monofilament microstructure control. This process stage preferably utilizes a heated water bath whose water temperature is kept at 97° C. The draw ratios can be those shown in FIG. 3. The total draw ration used for the above-noted three process stages can be between about 5 and 6.

The toughness and strength of the resulting monofilament will be affected by the miscrostructure formed during the above solid state processing of the extrudate. The microstructures are indirectly characterized by Differential Scanning Calorimerty (DSC) as described in more detail in the next section.

Tensile and Loop Strength, and Toughness Properties

Strength data for a monofilament is derived from uni-axial testing as detailed in ASTM D2256-97 A loop test is described in, e.g. W. E Morton and J. W. S. Hearle, "Physical Properties of Textile Fibers", The Textile Institute, Manchester $2^{nd}$ Ed. 1975 p. 410ff. The disclosure of this document is hereby expressly incorporated by reference in its entirety. Most highly oriented monofilaments that are loaded in the loop measurement show initiation of breakage by high extension of the outside layers. This is found to correlate with field application results of monofilament failure modes in the loop area of paper machine fabrics as shown in FIG. 1.

Two sets of data obtained from such uni axial tests are presented in the following examples. The first set shows the tensile data of a monofilament sample is placed in a tensile tester and loaded straight along the monofilament draw axis. The second set of data, also obtained with the tensile tester, shows the loop data, which is generated by loading the monofilament sample in a loop form, i.e., subjecting the looped areas of the monofilaments to tension.

Toughness is the work per unit mass (tex) required to rupture the straight or looped monofilaments, and can be conveniently calculated as the area of the stress-strain curve in the tensile test.

DSC Crystallinity

DSC is a thermal measurement and can be conveniently used to determine the crystallinity of a monofilament sample. DSC measures the enthalpy of the melting peak which is used to calculate the degree crystallinity and is defined as:

$$X_c = \frac{\Delta H}{\Delta H_c} \times 100\%$$

where ΔH is the melting enthalpy of the monofilament sample calculated from the DSC data, and $\Delta H_c$ is the melting enthalpy of a PET crystal (125.5 J/g), see, e.g., J. Brandcrup et al "Polymer Handbook", New York, John Wiley and Sons, Inc 1999)

Creep and Other Properties of the Fabrics

Two fabrics were manufactured identically but with different warp yarns. The control fabric used the typical commercially available monofilament the other fabric used the monofilament according to features of the invention.

The creep measurement was carried out on fabric strips at 125° C. at a tensile tester equipped with a temperature chamber. Constant tension was applied to the fabric strips, the fabric elongation was recorded as a function of time.

Example 1 and Comparison

A PET monofilament of high loop toughness (2.5 gf/den) was extruded continuously at a 2.5" single screw extruder and stretched subsequently at the draw stands and draw ovens. See FIG. 3.

The PET resin had an IV of 0.72 dl/g. The formulation of the polymer included a chemical hydrolysis stabilizer (carbodiimide) to minimize the polymer degradation.

The extrusion temperature was 300° C. at the extruder barrel and 310° C. at the extruder melt pump and head areas. The screw was a barrier screw designed with mixing sections at the tip. The extrusion rate was 760 g/minute, screw speed set as 50+/−1-1 rpm; and die pack pressure at 1,000+/−10 psi.

A uniform melt was achieved through the fine balance of the extrusion rate, the mixing barrier screw design and the die pack back pressure. The filtration at the die pack was through a stainless steel wire mesh of 40 micron open space.

The extrudates were quenched into water, at a temperature of 65° C. and were taken-up by a first roll stand at a speed of 100 feet per minute. They were subsequently stretched as detailed below.

The first draw process was through a heated water bath. The temperature of the water was kept at 97° C. The draw ratios for the experiments are shown in FIG. 3.

The stretched monofilaments were further fed through a hot air oven. The temperature of the hot air oven was kept at 204° C., with a air flow rate of 10 m/min. The stretch ratios (second draw ratios) for the experiments are also shown in FIG. 3.

The monofilaments were further fed through another two hot air ovens at a temperature of 221° C. at a air flow rate of >25 m/min. The monofilament feeding speed was faster than the take-up speed and the monofilaments were "relaxed" in the two ovens. The relax ratios for the experiments are also shown in FIG. 3.

The produced monofilaments were taken up, conditioned at room temperature at about 60% humidity, and tested. The measurements are detailed in FIG. 3.

The monofilaments in this example all had rectangular cross section, with a dimension of 0.36×0.67 mm.

FIG. 3 also summarizes the variation of the process conditions and their effect on the monofilament properties.

Example 2 (Fabrics) and Comparison

Figure 2:
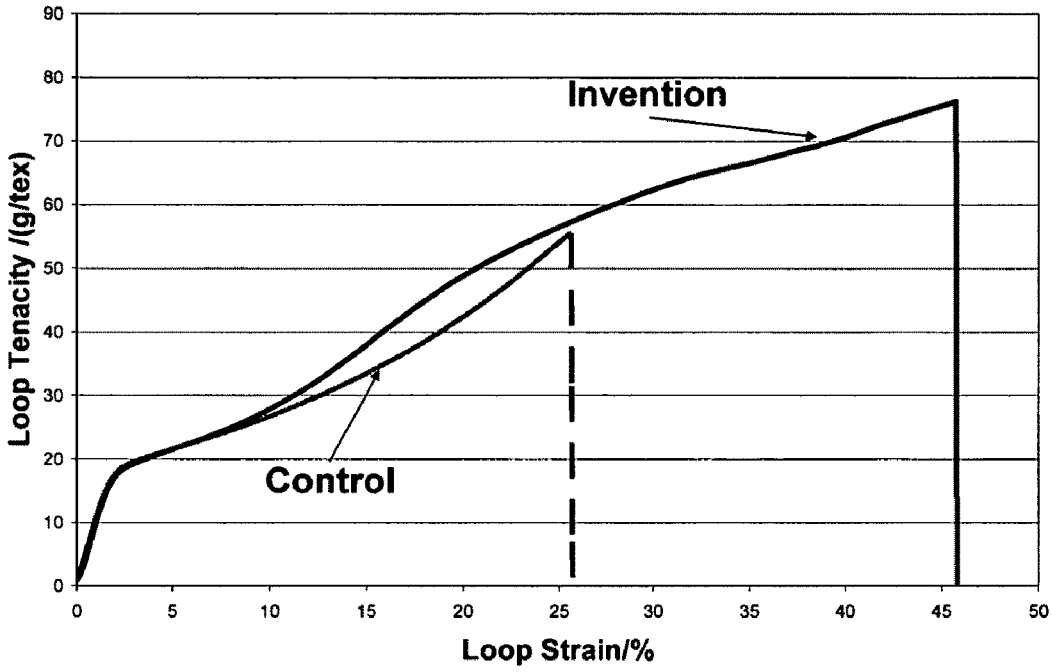
FIG. 2 is a graph comparing a prior art monofilament (control) to the monofilament of the invention with regard to loop stress-strain, with the y-axis designating loop tenacity in grams per tex (g/tex) and the x-axis showing loop strain in percent (%). The loop stress-strain behavior is at tensile testing with the area underneath the curve being the toughness of the loop rupture, or the work required to break the loop.

The "control" monofilament and the "invention" monofilament shown in FIGS. 2 and 3 were used as warp yarn (load bearing) in a woven fabric. The weaving process for the two yarns were identical. The woven fabrics were further "heat-set" to remove any residual weaving stress and to control the fabric properties.

The properties of the finished fabrics are shown in FIG. 4.

Further testing on the finished fabrics was carried out at 125° C. at various tensions. The fabrics were cut into 25.4 mm wide strips along the warp direction and clamped in a tensile tester with a pretension to keep the sample taut. Temperature and tension were applied to the sample, and its extension was recorded as a function of time. The results are summarized in FIG. 5.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A PET monofilament comprising:
a loop toughness of at least about 1.3 gf/den; and
a loop tenacity of at least about 7 gf/den.

2. The PET monofilament of claim 1, further comprising at least one of
a tensile toughness of at least about 0.9 gf/den;
a tensile tenacity of at least about 4 gf/den; and
a DSC crystallinity of at least about 35%.

3. The PET monofilament of claim 1, further comprising:
a tensile toughness of at least about 0.9 gf/den;
a tensile tenacity of at least about 4 gf/den; and
a DSC crystallinity of at least about 35%.

4. The PET monofilament of claim 1, wherein the loop toughness is at least about 2 gf/den.

5. The PET monofilament of claim 1, wherein the monofilament has a substantially round shaped cross section.

6. The PET monofilament of claim 1, wherein the monofilament has a substantially rectangular shaped cross section.

7. The PET monofilament of claim 1, wherein the monofilament has a substantially elliptical shaped cross section.

8. The PET monofilament of claim 1, wherein a smallest width of the cross section of the monofilament is greater than about 0.5 mm.

9. A paper machine fabric comprising plural PET monofilaments as in claim 1.

10. A process of making the PET monofilament of claim 1 comprising:
forming an extrudate;
quenching the extrudate;
stretching of the extrudate in a heat transfer medium; and
subjecting the stretched monofilament to relaxing in the heat transfer medium.

11. The PET monofilament of claim 1, wherein the PET monofilament is a paper machine clothing PET monofilament.

12. The process of claim 10, wherein the heat transfer medium comprises one of water, hot air, and steam.

13. A process of making a PET monofilament comprising:
feeding a dried polymer through a spinneret to form an extrudate;
water quenching the extrudate;
stretching of the extrudate in a heat transfer medium; and
subjecting the stretched monofilament to relaxing in the heat transfer medium.

14. The process of claim 13, wherein the PET monofilament comprises:
a loop toughness of at least about 1.3 gf/den; and
a loop tenacity of at least about 7 gf/den.

15. The process of claim 14, wherein the PET monofilament further comprises at least one of:
a tensile toughness of at least about 0.9 gf/den;
a tensile tenacity of at least about 4 gf/den; and
a DSC crystallinity of at least about 35%.

16. The process of claim 14, wherein the PET monofilament further comprises:
a tensile toughness of at least about 0.9 gf/den;
a tensile tenacity of at least about 4 gf/den; and
a DSC crystallinity of at least about 35%.

17. The process of claim 14, wherein loop toughness is at least about 2 gf/den.

18. A paper machine fabric comprising a plurality of monofilaments made by the process of claim 14.

19. A PET yarn comprising:
a loop toughness of at least about 2 gf/den;
a loop tenacity of at least about 7 gf/den;
a tensile toughness of at least about 0.9 gf/den;
a tensile tenacity of at least about 4 gf/den; and
a DSC crystallinity of at least about 35%.

20. A process of making the PET yarn of claim 19 comprising:
forming an extrudate;
quenching the extrudate;
stretching of the extrudate in a heat transfer medium; and
subjecting the stretched monofilament to relaxing in the heat transfer medium.

21. The process of claim 20, wherein the heat transfer medium comprises one of water, hot air, and steam.

22. The PET yarn of claim 19, wherein the PET yarn is a paper machine clothing PET yarn.

23. The process of claim 13, wherein the PET monofilament is a paper machine clothing PET monofilament.

* * * * *